United States Patent [19]

Oeschger

[11] 4,443,672

[45] Apr. 17, 1984

[54] LOW CAPACITANCE RADIO FREQUENCY SWITCH

[75] Inventor: Joseph E. Oeschger, Palo Alto, Calif.

[73] Assignee: International Telephone & Telegraph Corporation, New York, N.Y.

[21] Appl. No.: 347,896

[22] Filed: Feb. 11, 1982

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,908,780 | 10/1959 | Walters, Jr. | 200/144 B |
| 2,981,813 | 4/1961 | Jennings | 200/144 B |
| 3,446,926 | 5/1969 | Camacho | 200/144 B |

*Primary Examiner*—Robert S. Macon

*Attorney, Agent, or Firm*—T. E. Kristofferson; J. M. May

[57] ABSTRACT

A vacuum switch which is air operated and which has low contact capacitance, low inductance and low DC resistance. The switch has two fixed contacts and a moveable contact, the moveable contact being insulated from the moveable end structure to minimize coupling capacity between the two fixed contacts. A portion of the fixed contact support structure is cut away to minimize capacitance between the support structure and between the support structure and a ceramic body which is part of the switch vacuum envelope, the ceramic body insulating the contacts and the metal portions of the envelope.

4 Claims, 1 Drawing Figure

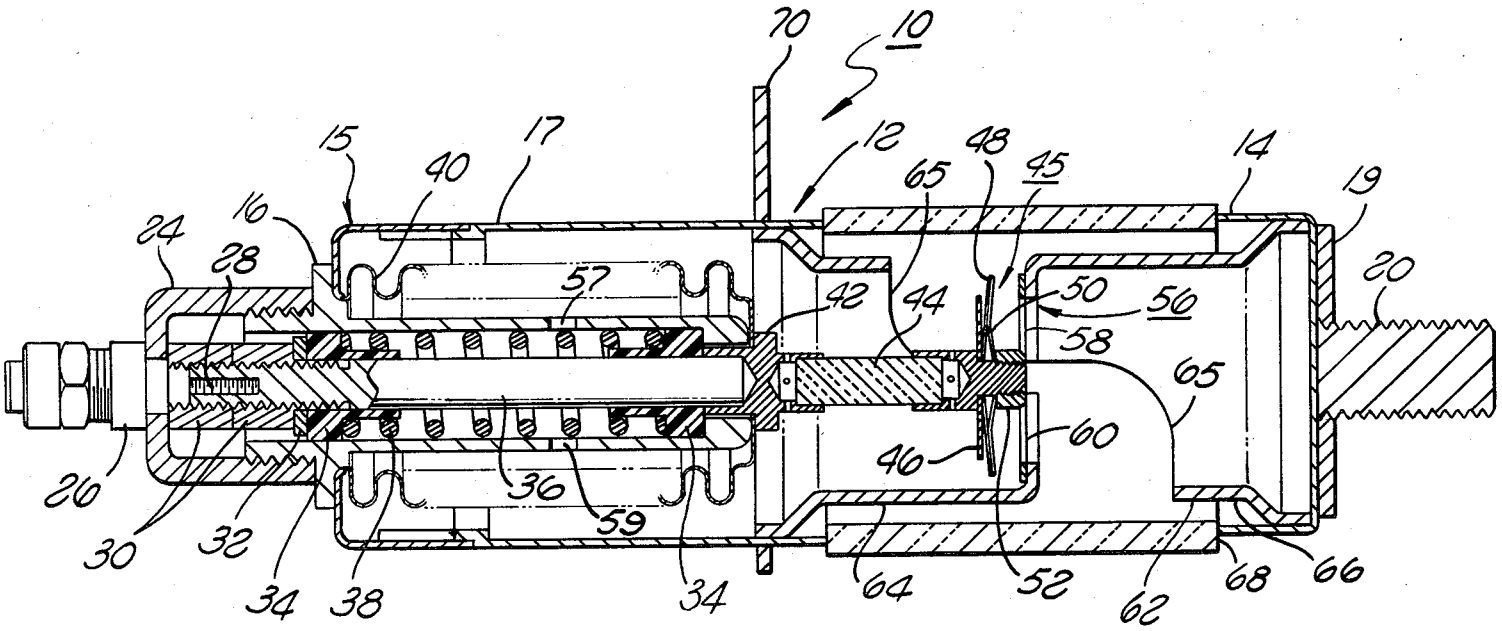
10
12
14
15
16
17
19
20
22
24
26
28
30
32
34
36
38
40
42
44
45
46
48
50
52
56
57
58
59
60
62
64
65
66
68

LOW CAPACITANCE RADIO FREQUENCY SWITCH

BACKGROUND OF THE INVENTION

Vacuum interrupters have been widely available in the prior art, the principal use being in high power utility and industrial applications. The inherent advantages of equipment using vacuum dielectric interrupters over other types include high interrupting speed, high speed operation, rapid dielectric recovery, reduction in size and weight, quiet operation, minimal maintenance requirements, long life and economy.

Vacuum interrupter switches have demonstrated superior performance for such RF applications as band switching of transmitters, switching of filter sections and antenna multicouplers, antenna reflector switching, tap changing of rf coils in induction and dielectric heating RF generators and switching of transmission lines. Most of these applications are in the RF band and involve currents ranging from 20 amperes to several hundred amperes.

Two typical prior art RF switches manufactured by ITT Jennings, San Jose, Calif., are the RP233 and the RF20 models.

The RP233 comprises fixed and moveable contacts mounted inside an evacuated ceramic-metal container. The fixed contact is mounted on a tube which forms part of the envelope structure. The moveable contact is mounted on the end of a bellows which also forms part of the envelope structure. A shaft and bearing arrangement position and guide the moveable contact. A compression spring on the outer end of the shaft holds the moveable contact open (away from the fixed contact). When air or other fluid pressure is applied to the inside of the bellows, it acts as an air cylinder and exerts a force which overcomes the compression spring and urges the moveable contact closed. Although this unit performs very satisfactorily, the RF current travels near the surface of the fixed contact tube and bellows. This fact results in (1) a large inductance in series with the switch contacts, and (2) large internal resistance in series with the switch contacts, thus limiting the RF current the unit can carry without excessive heating.

The RF20 comprises two fixed contacts supported from opposite ends of a ceramic cylinder, the inner contact being in the form of an annular ring, the outer contact in the form of an annular ring concentric to the inner ring and the axis of the unit. A circular disc supported by a shaft-bearing bellows arrangement, but isolated from it by an insulator, is moved towards the fixed contacts to close the electrical circuit. A compression spring connected to the moveable contact shaft holds the moveable contact away from the fixed contacts. When fluid pressure is exerted on the inside of the bellows, it acts like an air cylinder and exerts a force which overcomes the compression spring and urges the moveable contact disc closed. Although the RF20 also performs very satisfactorily, the unavoidable proximity of the fixed contacts results in high ($\approx$10 pf) open contact capacitance and thus high open circuit leakage current at HF and near VHF conditions. Further, the open contact capacitance is relatively insensitive to the position of the moveable contact due to large capacitance between the fixed contacts.

What is desired, therefore, is to provide an improved RF switch having a relatively low capacitance, inductance and resistance associated therewith with high RF current carrying capacity.

SUMMARY OF THE PRESENT INVENTION

The present invention provides a vacuum switch which has low contact capacitance, low inductance and low DC resistance. The switch has two fixed contacts and a moveable contact, the moveable contact being insulated from the moveable end structure to minimize coupling capacity between the two fixed contacts. A portion of the fixed contact support structure is cutaway to minimize capacitance between the support structure and between the support structure and a ceramic body which is part of the switch vacuum envelope, the ceramic body insulating the contacts and the switch portions of the envelope.

It is an object of the present invention to provide a low capacitance vacuum switch having high current carrying capabilities.

It is a further object of the present invention to provide a compact vacuum switch with low contact capacitance, low inductance and low DC resistance which has high current carrying capabilities.

It is still a further object of the present invention to provide an RF vacuum switch which is air operated and which has low contact capacitance, low inductance and low DC resistance which has high current carrying capabilities. The switch has two fixed contacts and a moveable contact, the moveable contact being insulated from the moveable end structure to minimize coupling capacity between the two fixed contacts. A portion of the fixed contact support structure is cut away to minimize capacitance between the support structure and between the support structure and a ceramic body which is part of the switch vacuum envelope, the ceramic body insulating the contacts and the metal portions of the envelope.

BRIEF DESCRIPTION OF THE DRAWING

For a better understanding of the invention as well as other objects and further features thereof, reference is made to the following description which is to be read in conjunction with the following figures wherein the sole FIGURE shows an axially-sectioned view of the low capacitance radio frequency switch of the present invention.

DESCRIPTION OF THE PREFERRED EMBODIMENT

Referring to the FIGURE, an axially-sectioned view of the low capacitance radio frequency switch 10 of the present invention is illustrated. The switch 10 includes hermetically sealed envelope 12, envelope 12 comprising a fixed metal end seal 14, preferably made of copper, a moveable end seal or cup 15 to provide support for a bearing 16, cylindrical metal portion 17 and a cylindrical ceramic body portion 18. A mounting reinforcement 19, made preferably of copper, and a mounting stud 20, preferably made of tellurium copper, are formed on the fixed end of envelope 12 as illustrated. At the moveable end of envelope 12 is provided a cover 24, fitting 26, ID thread 28 at the end of a shaft 36 (if necessary), adjustment nuts 30, optional washer 32 and two plastic bushings 34. Internally of envelope 12 is the shaft 36, compression spring 38 and bellows 40. A bellows end ceramic header 42 is provided to connect together shaft 36, bellows 40 and a ceramic rod 44. The connection between ceramic header 42 and ceramic rod 44 should be flexible enough to absorb differences in thermal expansion of the materials. The moveable contact assembly 45 of the present invention comprises a moveable contact support disc 46, moveable contact disc 48 and a Belleville spring washer 50. Support disc 46 prevents the overbending of moveable contact 48 and improves the conductive heat transfer thereof. The disc 46 is preferably made of molybdenum. Contact disc 48 is slightly bellevilled to allow it to better conform to the fixed contacts, described hereinafter. Typically, disc 48 comprises copper plated molybdenum, clad molybdenum or molybdenum with a copper shim on the fixed contact side for low electrical resistance and high thermal conductivity. Washer 50 preloads the moveable contact assembly so it cannot vibrate or "flutter" in the electrostatic field surrounding the contacts and is preferably made of molybdenum. A moveable contact assembly retaining nut 52 retains and preloads the moveable contact assembly and preferably is made of copper. A fixed contact assembly 56 comprising two segments 58 and 60 is positioned around nut 52. Segments 58 and 60 preferably each comprise mating halfs of a flat disc. Segment 58 is supported by cylindrical support, or tube, member 62, preferably made of copper for low resistance and high thermal conductivity, and segment 60 is supported by cylindrical support, or tube, member 64, preferably made of copper. As can be seen in the FIGURE, portions 65 of each cylindrical support member are removed, or cutaway, to minimize capacitance between support members 62 and 64 and between support members 62 and 64 and ceramic body portion 18. Note that portion 66 of support member 62 extends past the end of ceramic body portion 18 in order to provide corona protection of the brazejoint 68 between ceramic body portion 18 and fixed end seal 14.

A moveable end mounting flange 70 is provided to carry RF current and preferably is made of copper for low electrical resistance and high thermal conductivity.

Reviewing the function of several of the switch components shown in the FIGURE, cover 24 provides an enclosure so that the bellows 40 can be pressurized and sets open switch gap to the desired value by positioning cover 24 on threaded portion of bearing 16, the bearing 16 providing support and alignment of shaft 36 and part of the bellows pressuring system. Fitting 26 is used for pressuring bellows 40, thread 28 is provided if a connection to an auxiliary switch is required, adjustment nuts 30 adjusts the force on compression spring 37 thus setting the minimum fluid pressure required to close the switch, optional washer 32 is used to aid adjustment of spring compression and plastic bushings 34, which are self lubricating, are used to guide shaft 36 in bearing 16, restrain spring 37 from bowing and to provide frictional dampening to reduce spring surge. The innermost bushing 34 allows motion between its inner diameter and the outside surface of shaft 36 whereas outermost bushing 34 has motion between the outside diameter of the bushing itself and the inside of bearing 16. Several slots on the outside diameter of bushing 34 allow fluid to pass from fitting 26 to inside of bellows 40 through bleed holes 57 and 59. Shaft 36 provides an axis of motion for moveable contact assembly 45 and bellows 40 and connects compression spring 37 to bellows and compression spring 37 overcomes the atmospheric pressure on bellows 40 to provide for a normally open contact.

In summary, the two approximately semicircular annular fixed contacts 58 and 60 are supported by cylindrical members 62 and 64 from opposite ends of a ceramic body 18. A portion of each cylindrical support member opposite the fixed contact is cutaway to reduce fixed contact to fixed contact capacitance as well as support member to ceramic body capacitance. The cutaway portion of the cylindrical members stop short of the end of the ceramic body 18 so that it can provide corona protection to the adjacent ceramic to metal brazejoint between metal envelope portion 17 and ceramic body portion 18. A slightly bellevilled moveable contact disc 48, supported by a shaft-bearing bellows assembly, but insulated from it by a ceramic rod 44, is forced against the two fixed contacts 58 and 60 to close the circuit. The force applied by the bellows 40 flattens the moveable contact disc 48 (may comprise a solid disc or a disc with a plurality of slots, depending upon the flexibility desired) against the two fixed contact surfaces, thus insuring maximum contact between the three parts and thus minimum contact resistance and maximum thermal conductivity. The moveable disc contact 48 is held open (or away) from the fixed contacts 50 and 60 and a stop in the air cover assembly provides a means of fixing the open switch gap. When air or other fluid pressure is applied to the inside of the bellows 40, it behaves like an air cylinder and exerts a force which overcomes the compression spring and urges the moveable contact disc 48 to close onto the fixed contacts 58 and 60. Additionally, the shaft assembly rides in special plastic bushings 20 within the bearing so that no lubrication of the shaft is necessary.

The electrical connections are positioned as close as practical to the internal parts of the switch in order to minimize inductance and current generated losses.

The switch of the present invention is designed to be final brazed in vacuum. As noted hereinabove, the switch 10 is air operated. By removing the air cover 24 and connecting directly to the shaft 36, the switch 10 can be operated by any external means. As shown, switch 10 is of the normally open configuration. Switch 10 can be built as a normally closed switch by transposing the fixed contacts 58 and 60 on their support members, rotating the moveable contact parts so that they close against the fixed contacts 58 and 60 when the shaft 36 is withdrawn from the switch 10, using a longer insulating rod 18 between the bellows 40 and moveable contact support disc 46, and using a flanged nut in place of the plain hex nut on the end of the shaft 36 to limit inward motion of the shaft moveable contact 48.

Because of the shortness of the electrical current path, switch 10 provides for low open circuit capacitance, high dielectric withstand voltage and lowest practical inductance.

The switch of the present invention can be used in applications requiring a low capacitance, low inductance switch having high current carrying ability and high dielectric withstand voltage such as for RF tank coil tap changing; switching inductors and or capacitors in RF filter networks; antenna switching matrices and in low frequency or DC applications such as transformer tap changing; induction heating machine work coil switching; DC high voltage switches to RF tank circuits; and plating tank (metals and salts) disconnects.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. An RF vacuum switch having open and closed positions comprising:

an envelope having a tubular ceramic portion oriented along a first axis;

a moveable contact disc hermetically sealed within said envelope and including an axially operating bellows for permitting axial motion parallel to said first axis to be imparted to said moveable contact disc by means of a control member external to said envelope;

a pair of fixed contacts within said envelope and positioned with respect to said moveable contact means to operatively engage said moveable contact means when the vacuum switch is in the closed position;

a first cylindrically shaped member within said envelope and extending in a first direction along said first axis away from said pair of fixed contacts for supporting a first one of said fixed contacts; and a second cylindrically shaped member within said envelope and extending in a second direction along said first axis away from said pair of fixed contacts, said second direction being opposite to said first direction, for supporting a second one of said fixed contacts, said first and second cylindrically shaped members being mounted to said envelope at opposite ends of said ceramic portion, both said first and second cylindrically shaped members having respective cutaway portions respectively in the vicinity of said second and first fixed contacts to minimize capacitance effects between said first and second cylindrically shaped members.

2. The RF vacuum switch of claim 1, wherein said cutaway portions additionally serve to minimize any capacitance effect between said ceramic portion and said first and second cylindrically shaped members.

3. The RF vacuum switch of claim 1, further comprising:

a seal member for sealing one end of said envelope, said seal member being brazed to one end of said ceramic portion to form a brazejoint therebetween, said first cylindrically shaped member extending past said brazejoint to provide corona protection of said brazejoint.

4. The RF vacuum switch of claim 1, wherein said two fixed contacts have the shape of a split annulus located about said first axis and on a common plane perpendicular thereto; and wherein said contact supporting portion of said first cylindrically shaped member and said contact supporting portion of said second cylindrically shaped member are attached, respectively, to said first and second fixed contacts at a surface thereof remote from said moveable contact.

* * * * *